US011187407B2

(12) United States Patent
Braig et al.

(10) Patent No.: US 11,187,407 B2
(45) Date of Patent: Nov. 30, 2021

(54) MIXING DEVICE AND BURNER HEAD FOR A BURNER WITH REDUCED NOX EMISSIONS

(71) Applicant: Max Weishaupt GmbH, Schwendi (DE)

(72) Inventors: Frank Braig, Orststeil Rot (DE); Hubert Gaub, Orststeil Rot (DE); Stefan Mack, Ortsteil Pfuhl (DE); Florian Wohnhas, Orsteil-Hörenhausen (DE)

(73) Assignee: MAX WEISHAUPT GMBH, Schwendi (DE)

( * ) Notice: Subject to any disclaimer, the term of this patent is extended or adjusted under 35 U.S.C. 154(b) by 312 days.

(21) Appl. No.: 16/473,161

(22) PCT Filed: Dec. 12, 2017

(86) PCT No.: PCT/EP2017/082486
§ 371 (c)(1),
(2) Date: Jul. 25, 2019

(87) PCT Pub. No.: WO2018/114490
PCT Pub. Date: Jun. 28, 2018

(65) Prior Publication Data

US 2020/0386401 A1 Dec. 10, 2020

(30) Foreign Application Priority Data

Dec. 22, 2016 (DE) ..... 10 2016 125 526.2

(51) Int. Cl.
*F23D 14/02* (2006.01)
*F23D 14/26* (2006.01)
(Continued)

(52) U.S. Cl.
CPC ..... *F23D 14/02* (2013.01); *F23D 14/26* (2013.01); *F23D 14/60* (2013.01); *F23D 14/62* (2013.01);
(Continued)

(58) Field of Classification Search
CPC ..... F23D 11/40; F23D 14/08; F23D 11/406; F23D 14/02; F23D 14/26; F23D 14/60; F23D 14/62; F23D 14/70
See application file for complete search history.

(56) References Cited

U.S. PATENT DOCUMENTS 4,150,631 A * 4/1979 Frey ..... F23D 1/00 110/186
4,566,268 A * 1/1986 Hoffeins ..... F23D 17/002 60/39.463
(Continued)

FOREIGN PATENT DOCUMENTS

DE 7806382 U1 7/1978
DE 4118261 A1 12/1992
(Continued)

*Primary Examiner* — Jason Lau
(74) *Attorney, Agent, or Firm* — Nelson Mullins Riley & Scarborough LLP; Kongsik Kim, Esq.

(57) ABSTRACT

To further reduce the NOx emission, the invention provides a mixing device (10) for a burner (16) having reduced NOx production, comprising a centrally arranged first mixing unit (18) for producing a first fuel-air mixture for a primary flame zone (120), wherein the first mixing unit (18) has at least one first fuel nozzle (38) and a baffle plate (40), a second mixing unit (20) for producing a second fuel-air mixture for a secondary flame zone (122), which encloses the primary flame zone (120), wherein the second mixing unit (20) has multiple second fuel nozzles (70), characterized by a sealing air producing unit (24) for producing a sealing air flow in a sealing air zone, which encloses the primary flame zone (120) of the first mixing unit (18) arranged downstream of
(Continued)

the baffle plate (40), wherein the second mixing unit (20) is designed to deliver the second fuel-air mixture into the secondary flame zone (122), which encloses the sealing air zone (126), and wherein the second mixing unit (20) is arranged around the sealing air producing unit (24), and by a third mixing unit (22) which is arranged radially between the sealing air producing unit (24) and the second mixing unit (20) and has a swirl generator (76) and at least one third fuel nozzle (74), which is arranged upstream of the swirl generator (76) in a premixing zone (78), through which a swirled air flow flows to the swirl generator (76), to premix fuel from the third fuel nozzle (74) with the swirled air flow before the swirl generation.

20 Claims, 5 Drawing Sheets

(51) Int. Cl.

| | |
|---|---|
| ***F23D 14/60*** | (2006.01) |
| ***F23D 14/62*** | (2006.01) |
| ***F23D 14/70*** | (2006.01) |

(52) U.S. Cl.
CPC ..... *F23D 14/70* (2013.01); *F23D 2205/00* (2013.01); *F23D 2208/00* (2013.01)

(56) References Cited

U.S. PATENT DOCUMENTS

| | | | | | |
|---|---|---|---|---|---|
| 5,460,514 | A * | 10/1995 | Toyoshima | F23D 11/40 | 431/183 |
| 5,700,143 | A * | 12/1997 | Irwin | F23D 17/002 | 431/182 |
| 2014/0202365 | A1* | 7/2014 | Sturgeon | F23K 3/02 | 110/347 |
| 2014/0308619 | A1* | 10/2014 | Wartluft | F23C 7/004 | 431/9 |

FOREIGN PATENT DOCUMENTS

| | | | |
|---|---|---|---|
| DE | 19519696 | A1 | 2/1996 |
| DE | 102007009922 | A1 | 8/2008 |
| DE | 102007023299 | B4 | 3/2012 |
| EP | 0913631 | A2 | 5/1999 |
| JP | 2000130757 | A | 5/2000 |

* cited by examiner

MIXING DEVICE AND BURNER HEAD FOR A BURNER WITH REDUCED NOX EMISSIONS

TECHNICAL FIELD

The invention relates to a mixing device for a burner having reduced NOx emission, comprising: a centrally arranged first mixing unit for delivering a first fuel-air mixture into a primary flame zone, wherein the first mixing unit has at least one first fuel nozzle and a baffle plate, and a second mixing unit for delivering a second fuel-air mixture into a secondary flame zone, which encloses the primary flame zone, wherein the second mixing unit has multiple second fuel nozzles. Furthermore, the invention relates to a burner head provided with such a mixing device and also a burner provided with such a burner head. Furthermore, the invention relates to a combustion method which can be carried out using such a mixing device, such a burner head, and such a burner.

BACKGROUND ART

Such a mixing device, such a burner head, and such a burner and also combustion methods which can be carried out thereby are known from the following citations from the prior art: EP 0 913 631 A2 (D1), "Weishaupt WKGL70 dual fuel burner Version 3LN (Low $No_x$) multiflam®", Weishaupt Corporation, Mississauga, printing number 83204616, March 2004 (D2); "Weishaupt Monarch® WM-GL10 multiflam®", printing number 83192001, March 2009 (D3); and "Weishaupt Produkt Information über Öl-, Gas- und Zweistoffbrenner [product information about oil, gas, and dual fuel burners]", printing number 83211401, November 2015 (D4).

In the above-mentioned documents, burners having burner heads and mixing devices housed therein are known, which have a first mixing unit for supplying a central primary flame with a first fuel-air mixture and a second mixing unit for supplying a secondary flame with a second fuel-air mixture and enable a combustion with particularly low nitrogen oxide production. Reference is expressly made to above-mentioned documents D1 to D3 for further details on the action principle and the construction of the known burners and burner heads. In particular, a central primary flame is produced in a manner supported by the baffle plate, wherein a majority of the burner power is effectuated via an outer secondary flame. The primary flame stabilizes the combustion while combustion-chamber-internal exhaust gas recirculation is enabled via the secondary flame.

Proceeding from this prior art, the invention has the object of enabling combustion with even lower nitrogen oxide production, also with particularly high burner powers.

SUMMARY OF THE DISCLOSURE

To achieve this object, the invention provides a mixing device according to claim 1 and a method according to the concurrent method claim. Furthermore, the invention provides a burner head provided with such a mixing device and also a burner provided therewith according to the further concurrent claims.

Advantageous embodiments are the subject matter of the dependent claims.

According to one aspect, the invention provides a mixing device for a burner having reduced NOx production, comprising: a centrally arranged first mixing unit for producing a first fuel-air mixture for a primary flame zone, wherein the first mixing unit has at least one first fuel nozzle and a baffle plate; a second mixing unit for producing a second fuel-air mixture for a secondary flame zone, which encloses the primary flame zone (120), wherein the second mixing unit has multiple second fuel nozzles; a sealing air producing unit for producing a sealing air flow in a sealing air zone, which encloses the primary flame zone of the first mixing unit arranged downstream of the baffle plate, wherein the second mixing unit is designed to deliver the second fuel-air mixture into the secondary flame zone, which encloses the sealing air zone; and a third mixing unit for premixing and swirling a third fuel-air mixture and for delivering the premixed and swirled third fuel-air mixture into a swirled flame zone, which is arranged between the sealing air zone and the secondary flame zone.

The baffle plate can be a separate part or a region of a larger body or a construction.

Preferably, in a top view opposite to an air flow direction prevailing in operation of the mixing device, which preferably flows substantially in an axial direction of a burner tube of a burner head, a ring-shaped arrangement of the mixing units is provided, wherein the first mixing unit is provided in the centre, the second mixing unit is provided on the outside, and the third mixing unit is provided therebetween. The sealing air producing unit is preferably arranged between the first and the third mixing units. This preferred arrangement relates to the arrangement viewed in the radial direction, in the axial direction the units can be offset in relation to one another.

It is preferable for the third mixing unit to be arranged, in particular radially, between the sealing air producing unit and the second mixing unit, and to have a swirl generator and at least one third fuel nozzle, which is arranged upstream of the swirl generator in a premixing zone, through which an air flow flows to the swirl generator, to premix fuel from the third fuel nozzle with the air flow before the swirl generation.

It is preferable for a baffle plate construction to be provided which has, viewed from a centre of the mixing device (10) outward, in this sequence a) the baffle plate having at least one opening for the first fuel nozzle,
b) a sealing air duct for producing the sealing air flow;
c) the swirl generator, and
d) a guiding unit for delimiting an outer air gap for the second mixing unit.

The sealing air duct is preferably provided with at least one first partition wall for partitioning the sealing air flow in relation to the primary flame zone.

The sealing air duct is preferably provided with a second partition wall for partitioning the sealing air flow in relation to the outlet of the swirl generator.

It is preferable for the baffle plate to be designed to produce a swirl in the primary flame zone. A first swirl generating unit of the first mixing unit for the primary flame zone can thus be provided in the centre, which preferably with the sealing air producing unit therebetween is enclosed by a second swirl generating unit for the third mixing unit The baffle plate preferably ensures a (substantially) greater air resistance than the swirl generator and/or the outer air gap.

It is preferable for a positioning unit to be provided for increasing or reducing in size an air gap, wherein the positioning unit is designed to change the size of the air gap in dependence on a load operating state.

The positioning unit is preferably configured to change the axial location of at least a part of the first mixing unit and/or the sealing air producing unit and/or the swirl generator and/or an air guiding unit.

One preferred design of the invention relates to a mixing device for a burner having reduced NOx production, comprising: a centrally arranged first mixing unit for producing a first fuel-air mixture for a primary flame zone, wherein the first mixing unit has at least one first fuel nozzle and a baffle plate, a second mixing unit for producing a second fuel-air mixture for a secondary flame zone, which preferably encloses the primary flame zone in a ring shape, wherein the second mixing unit has multiple second fuel nozzles, a sealing air producing unit for producing a sealing air flow in a sealing air flow zone, which preferably encloses the primary flame zone of the first mixing unit, which is arranged downstream of the baffle plate, in a ring shape, wherein the second mixing unit is designed to deliver the second fuel-air mixture into the secondary flame zone, which preferably encloses the sealing air zone in a ring shape, and wherein the second mixing unit is preferably arranged in a ring shape around the sealing air producing unit, and a third mixing unit, which is arranged radially between the sealing air producing unit and the second mixing unit and has a swirl generator and at least one third fuel nozzle, which is arranged upstream of the swirl generator in a premixing zone, through which a swirling air flow flows to the swirl generator, to premix fuel from the third fuel nozzle with the swirling air flow before the swirl generation.

One preferred design of the mixing device comprises a fuel supply unit for supplying the first, second, and third mixing units with fuel, wherein the fuel supply is controllable in such a way that the quantity ratio of the fuel supplied to the second and third mixing units is changeable.

One preferred design of the mixing device comprises a fuel supply controller for controlling the fuel supply unit, wherein the fuel supply controller is designed in such a way that a fuel supply to the third mixing unit is throttled or closed in a part-load mode and is open in a full-load mode.

It is preferable for the fuel supply unit to have a control valve for changing a flow cross section of a fuel supply line of the at least one third fuel nozzle.

It is preferable for a positioning unit to be provided for changing the axial location of at least a part of the first mixing unit and/or the sealing air producing unit, which is designed to change the axial location in dependence on a load operating state.

It is preferable for the control valve to be coupled to the positioning unit.

It is preferable for the sealing air producing unit to have a ring body having a ring duct for the sealing air.

It is preferable for the ring duct to be formed on a baffle plate ring body, which forms the baffle plate and the ring body.

It is preferable for the swirl generator to have a swirl generating ring arranged around the ring duct having a ring-shaped arrangement of swirl generating blades.

It is preferable for the swirl generating ring to be formed on the ring body.

According to a further aspect, the invention provides a burner head for a burner having reduced NOx production, comprising a burner tube and a mixing device arranged in the burner tube according to one of the above-explained designs.

It is preferable for the outer air gap for delivering the second fuel-air mixture of the second mixing unit to be delimited on the outside by a region of the burner tube.

According to a further aspect, the invention provides a burner having a mixing device according to one of the above-explained designs and/or a burner head as explained above.

According to a further aspect, the invention provides a method for combusting a fuel having reduced NOx production, comprising: producing a central primary flame in a central primary flame zone by means of a first central fuel nozzle and a baffle plate; producing a secondary flame in an outer secondary flame zone, which preferably encloses the primary flame zone in a ring shape, producing a sealing air flow, which preferably encloses the primary flame zone in a ring shape, between the primary flame zone and the secondary flame zone, and premixing fuel and air in a premixing zone, swirling the premixed fuel-air mixture, and delivering the swirled premixed fuel-air mixture into a swirled air zone, which is arranged between the sealing air flow enclosing the primary flame zone and the secondary flame zone.

The method is preferably carried out using a mixing device according to one of the above-explained designs, a burner head, or a burner according to one of the above-explained designs.

Further advantageous embodiments of the invention result by combination of one or more of the above-mentioned designs with features from EP 0 913 631 A2; "Weishaupt WKGL70 dual fuel burner Version 3LN (Low $No_x$) multiflam®", Weishaupt Corporation, Mississauga, printing number 83204616, March 2004; "Weishaupt Monarch® WM-GL10 Multiflam®", printing number 83192001, March 2009; and "Weishaupt Produkt Information über Öl-, Gas- und Zweistoffbrenner [product information about oil, gas, and dual fuel burners]", printing number 83211401, November 2015.

DETAILED DESCRIPTION OF EMBODIMENTS OF THE INVENTION

An exemplary embodiment will be explained in greater detail hereafter on the basis of the appended drawings.

Figure 1:
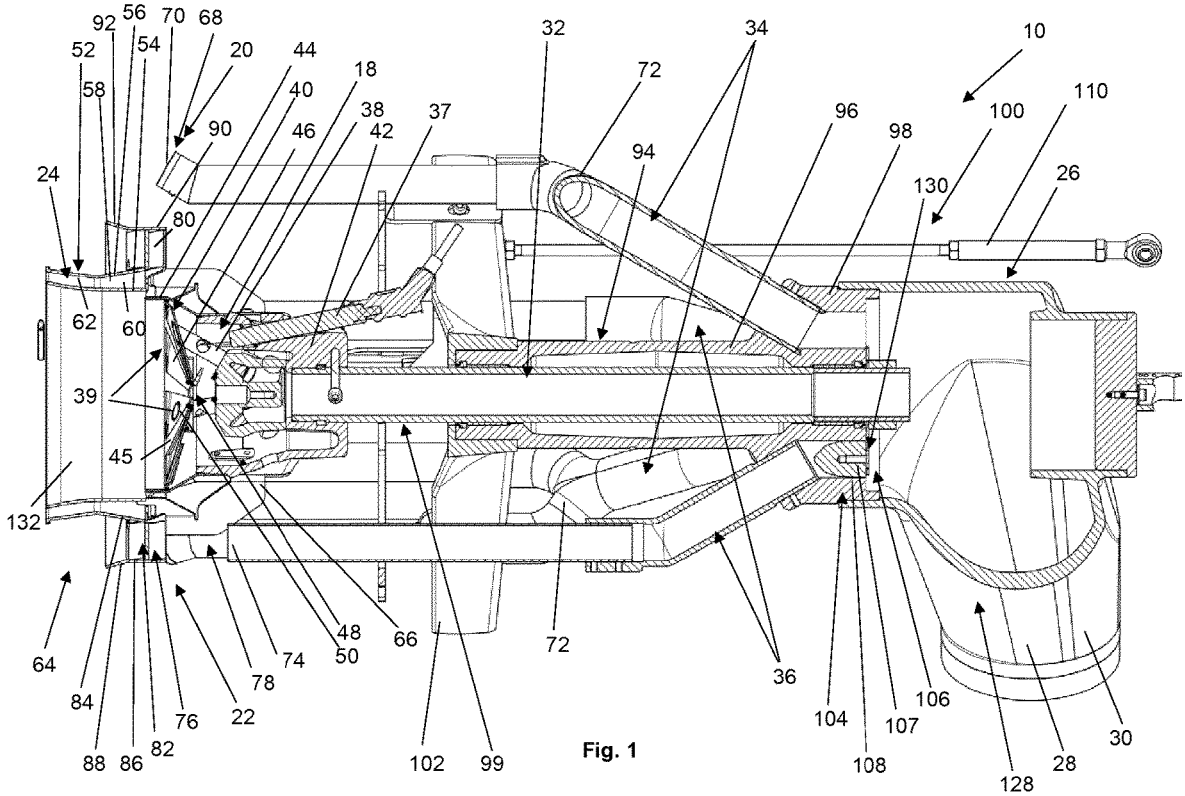
FIG. 1 shows a cross-sectional illustration through the middle of an embodiment of a mixing device for a burner having reduced NOx production.
Figure 2:
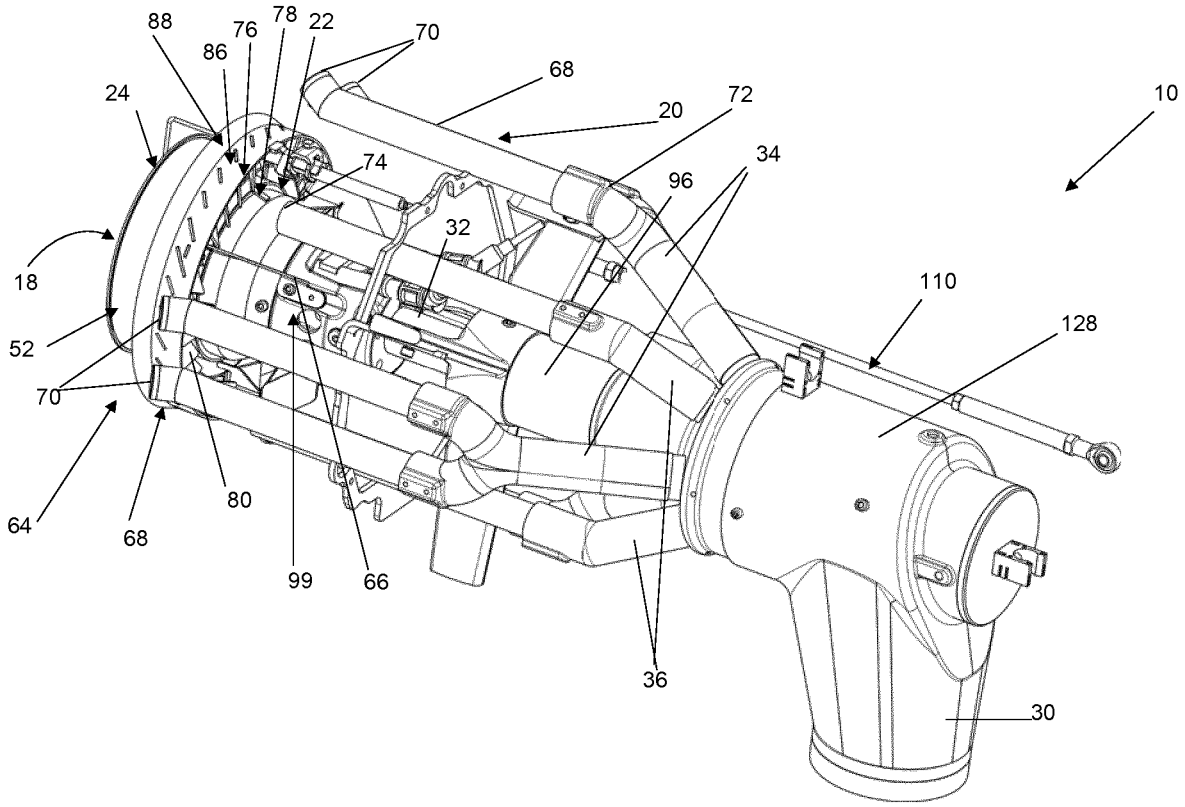
FIG. 2 shows a perspective illustration of the mixing device of FIG. 1.
Figure 3:
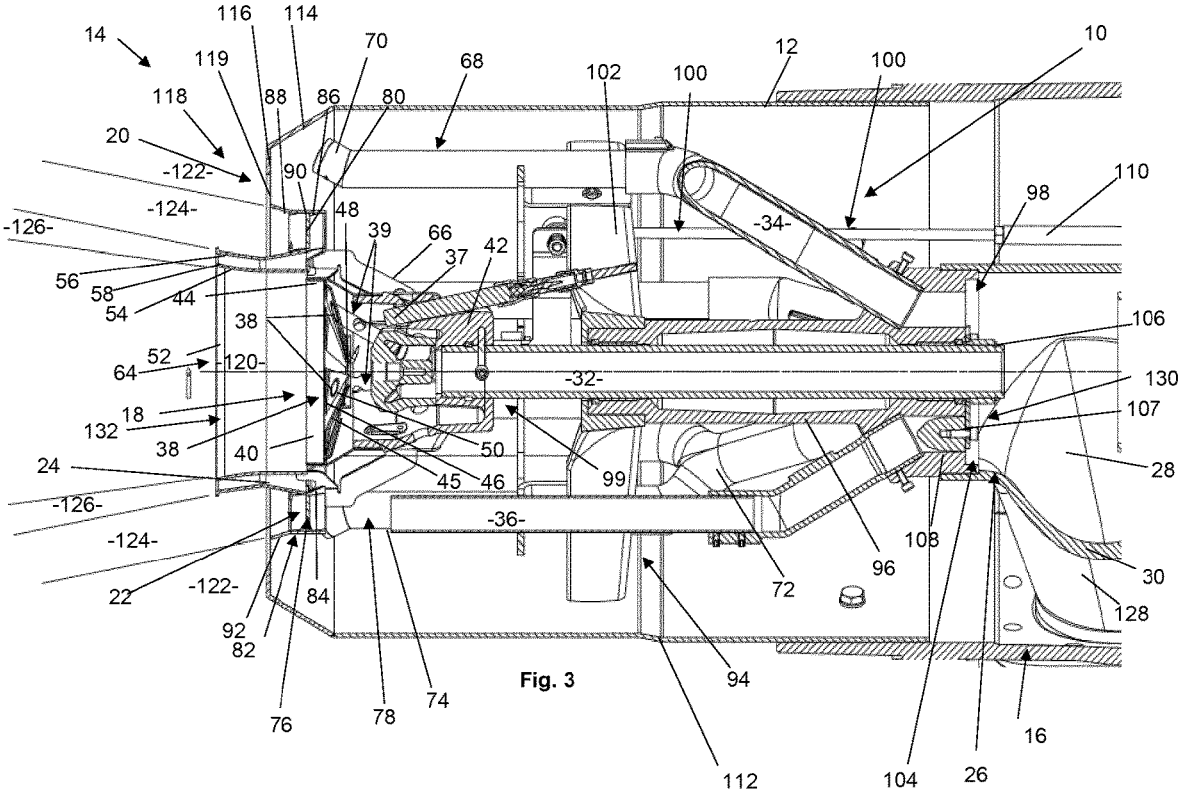
FIG. 3 shows a sectional illustration through a burner head having the mixing device of FIG. 1 with an explanation of different flame zones in operation of the burner provided with the burner head.
Figure 4:
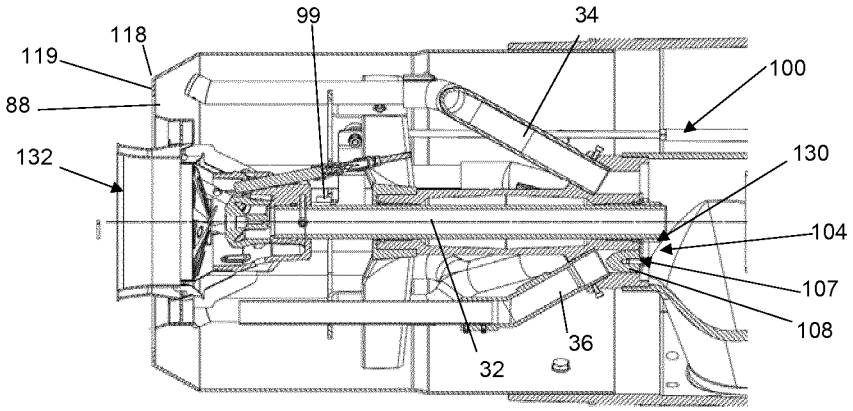
FIG. 4 shows a sectional illustration through the burner head in a setting for a part load.
Figure 5:
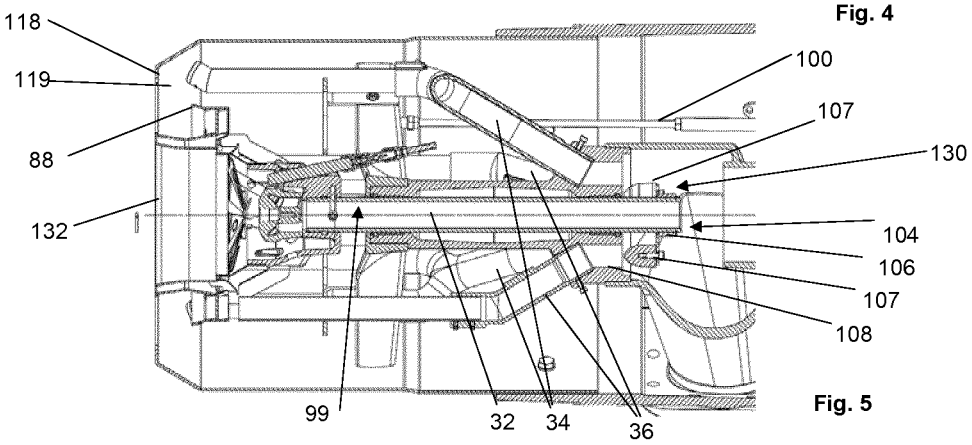
FIG. 5 shows the illustration of FIG. 4 with a setting for a full load.

A mixing device 10 for a burner having reduced NOx production is illustrated in FIGS. 1 and 2, which, as illustrated in FIGS. 3 to 5, is to be arranged in a burner tube 12 of a burner head 14 of a burner 16.

The mixing device 10 has a first mixing unit 18, a second mixing unit 20, and a rd mixing unit 22, and also a sealing air producing unit 24 and a fuel supply unit 26.

The fuel supply unit 26 has a central fuel supply feed 28, in particular a gas supply line 30, from which a first fuel supply line 32 for supplying the first mixing unit 18 with fuel, a second fuel supply line 34 for supplying the second mixing unit 20 with fuel, and a third fuel supply line 36 for supplying the third mixing unit 22 with fuel branch off.

The first mixing unit 18 has at least one first fuel nozzle 38 and a baffle plate 40. The at least one first fuel nozzle 38 can be arranged in the centre. In the illustrated exemplary embodiment, the first fuel nozzle 38 is part of a first fuel nozzle unit 39 having multiple first fuel nozzles 38 (for example, three first fuel nozzles, two, four, five, or six are also possible), which deliver fuel through openings 50, which are distributed uniformly in the circumferential direction in a middle region of the baffle plate 40.

Furthermore, an ignition device 37 is provided on the first mixing unit 18 to ignite the first fuel-air mixture produced by the first mixing unit 18.

The first fuel nozzle 38 is connected to the first fuel supply line 32, which extends linearly and centrally through the mixing device 10. A support body 42, from which fuel line branches, which are provided with openings for air entry, of the first fuel nozzles 38 lead to the openings 50 in the baffle plate, is arranged for this purpose on the end of the first fuel supply line 32 facing toward the combustion chamber.

The baffle plate 40 has an outer ring flange 44, a plate region 45, and multiple radially extending blades 46 arranged inclined, which are formed by notching from the plate region. The baffle plate 40 has a central opening 48 and the multiple further openings 50 for the first fuel nozzles 38 in some of the blades 46 or the plate region 45.

The sealing air producing unit 24 has a ring body 52, which extends axially downstream from the baffle plate 40, i.e., to the left in FIG. 1, and extends in the direction of the combustion chamber in operation and has an inner wall 54 and an outer wall 56, between which a ring duct 58 is formed. The ring duct 58 is arranged in the radial direction outside the baffle plate 40, i.e., viewed in the top view from the left in FIG. 1, the ring duct 58 encloses the baffle plate 40. In other words, the sealing air producing unit 24 is arranged around the first mixing unit 18 viewed in the radial direction. The ring duct 58 has a region 60 tapering in the downstream direction and an orifice region 62 oriented in the downstream direction and diagonally outward. A Venturi nozzle for increasing the flow speed of the sealing air is provided by the tapering region, which is delivered oriented slightly inclined outward through the orifice region 62.

The walls 54 and 56 simultaneously form in the flow direction, i.e., in operation, partition walls protruding into the combustion chamber for partitioning the orifice region of the first mixing unit 18 from the orifice region of the third mixing unit 20.

The ring body 52 and the baffle plate 40 can be formed on a shared component—a baffle plate ring body 64—or can be embodied separately. They are preferably connected to one another and are fastened jointly on the support body 42 by means of struts 66. The ring body and the baffle plate are thus part of a baffle plate construction 132, which is explained in greater detail hereafter.

The second mixing unit 20 has multiple fuel nozzle units 68, which are arranged at equal intervals around the first mixing unit 18, each having at least one second fuel nozzle 70. In the illustrated exemplary embodiment, each fuel nozzle unit 68 has multiple second fuel nozzles 70, which are arranged adjacent to one another, for example. For example, two second fuel nozzles 70 are provided per fuel nozzle unit 68, wherein three fuel nozzle units 68 are provided, for example. Each fuel nozzle unit 68 is connected to one second fuel supply line 34, which has a fork 72 to supply the multiple second fuel nozzles 70 of each fuel nozzle unit 68 with fuel. The orifices of the second fuel nozzles 70 are oriented downstream and diagonally outward.

The third mixing unit 22 is arranged radially between the second mixing unit 20 arranged on the outside and the sealing air producing unit 24 and has multiple third fuel nozzles 74—or, in designs which are not shown, multiple third fuel nozzle units each having multiple third fuel nozzles 74—wherein the third fuel nozzles 74 or the third fuel nozzle units having them are preferably arranged distributed at equal intervals around the central first mixing unit 18. In one exemplary embodiment, for example, three third fuel nozzles 74 are provided, it can also be two, four, five, or more.

Furthermore, the third mixing unit 22 has a swirl generator 76. The third fuel nozzles 74 are arranged with spacing upstream of the swirl generator 76, so that a premixing zone 78 is formed between the third fuel nozzles 74 and the swirl generator 76.

The swirl generator 76 has a ring-shaped arrangement 82 of swirl generating blades 88. The arrangement 82 has an inner support ring 84 and an outer support ring 86, between which the individual swirl generating blades 80 extend in the radial direction and oriented diagonally in relation to the flow direction.

The swirl generator 76 is arranged around the sealing air producing unit 24 viewed in the radial direction.

The swirl generator 76 is preferably part of the baffle plate construction 132. In the illustrated exemplary embodiment, the swirl generator 76 is formed or externally fastened on the ring body 52 of the sealing air producing unit 24. In the illustrated exemplary embodiment, the inner support ring 84 is formed by the outer wall 56 of the ring body 52, wherein the outer support ring 86 simultaneously forms a guiding unit 88 for combustion air for the second mixing unit 20. In other embodiments (not shown in greater detail), the guiding unit 88 is provided as a separate element.

The guiding unit 88 has a ring region 90 extending essentially in the axial direction and a ring region 92 extending diagonally outward at the end oriented downstream.

Furthermore, the mixing device 10 has a support construction 94 for fastening the mixing unit 10 in the burner tube 12. The support construction 94 has a stationary central tubular support body 96, which is fastened at its end oriented upstream on the fuel supply feed 28 and has a line branch 98 for allocating the fuel onto the fuel supply lines 32, 34, 36.

The centrally arranged first fuel supply line 32 is formed by a tube which is displaceably accommodated inside the support body 96. A positioning unit 100, by means of which the axial location of the central unit 99 may be changed, engages on the displaceable central unit 99 having the support body 42, the first fuel supply line 32, and at least the guiding device 88. In the illustrated exemplary embodiment, the displaceable central unit 99 also comprises the baffle plate construction 132 having the baffle plate 40, the ring body 52 for the ring duct 58, and the swirl generator 76, on which the guiding unit 88 is arranged or formed.

The end of the support body 96 oriented upstream is fixable by means of fastening struts 102.

A control valve 104 is provided on the line branch 98, using which a fuel supply to at least one of the mixing units 18, 20, 22, here, for example, to the third mixing unit 22, or to a part of one of the mixing units 20, 22, may be throttled or switched on or switched off.

In the embodiment illustrated here, the control valve 104 controls the fuel supply to the third mixing unit 22. In other variants, the control valve 104 controls the fuel supply to a subgroup of the second fuel nozzles 74, while a remaining group of the second fuel nozzles 74 remains uninfluenced by the control valve 104. In other variants, multiple control valves 104 are provided, preferably in such a way that they are activated jointly.

In the illustrated embodiment, the control valve 104 has a positioning element 106 fastened on the end of the first fuel supply line 32 oriented upstream and one closure body 107, in the form of a projection having tapering tip here, per fuel supply line 36 to be controlled, which closure body may be moved by displacement of the positioning element 106 in the axial direction into the entry opening 108 of the respective third fuel supply line 36 to reduce the flow cross section of the third fuel supply line 36 or close the entry opening 108 entirely and may be moved out of the entry opening 108 upon displacement in the reverse direction, to enlarge the flow cross section of the third fuel supply line 36, until the entry opening 108 is entirely released in the other setting.

The positioning unit 100 has a pushrod 110, which is connected to the support body 42 in a manner which is not shown, to axially displace the central unit of the mixing device. This axial displacement simultaneously effectuates the adjustment of the positioning element 106 of the control valve 104. The pushrod 110 is connected in operation to an actuator (not shown), for example, a lever actuated using a positioning motor, which is in turn activatable by a fuel supply controller (not shown) for controlling the fuel supply unit 26.

FIGS. 3 to 5 show the burner head 14 of the burner 16, wherein the mixing device 10 is housed in the burner tube 12 of the burner head 14. The burner 16 is a forced-air burner having a fan (not shown here), which ensures an air flow of combustion air through the burner tube 12 in the axial direction from the right viewed in FIG. 3 to the left viewed in FIG. 3. A strong axially oriented air flow is thus applied to the entire burner tube 12 in operation.

The fan is also controlled by a controller to set the strength of the air flow depending on load. Tapers in the region of the air flow path are used as Venturi units for locally increasing the flow speed.

The burner tube 12 is substantially circular-cylindrical and has a first tapering point 112 in a middle region and a second tapering point 114 at the end region oriented on the combustion chamber. The wall 116 of the burner tube is formed tapering diagonally inward viewed in the downstream direction at the tapering points 112. Furthermore, a ring-shaped end flange 116 protruding inward is formed at the downstream end, the inner edge of which defines or forms the burner tube opening 118. The combustion chamber opening 118 is larger than the outer diameter of the combustion-chamber-side end or edge of the guiding unit 88. An outer air gap in the form of a ring gap 119, which is used for delivering the second fuel-air mixture produced by the second mixing unit 20, is thus formed between the end flange 116 and the edge of the guiding unit 88. The second fuel nozzles 70 discharge upstream of this ring gap 119 close to the second tapering point, so that good mixing of the fuel from the second fuel nozzles 70 with combustion air is provided by the high air flow prevailing here.

The combustion air is allocated in the region of the combustion chamber opening 118 by the construction shown here of the mixing device 10, wherein combustion air is accumulated in a central region by the baffle plate 40 and flows through the central opening 48, through slots between the blades 46, and through an inner ring gap between the ring flange 44 and the ring body 52. This air flow is swirled by the blades 46. Preferably gaseous fuel is added to this part of the combustion air by the at least one first fuel nozzle 38, so that in a central region, which is defined viewed in the radial direction by the interior of the ring body 52, a primary flame forms, so that this region is referred to as the primary flame zone 120. The ignition takes place with the aid of the ignition device 37 at this primary flame zone 120 for the operating start of the burner.

Fuel is admixed into an outer ring region of the combustion air flow by the second mixing unit 20 via the second fuel nozzles 70, so that the second fuel-air mixture thus resulting passes through the outer ring gap 119 between the end flange 116 and the guiding unit 88 to produce a secondary flame in a secondary flame zone 122, which extends on the outside in a ring shape around the primary flame zone 120. The ignition of the secondary flame takes place via the primary flame. For this purpose, in a part-load range, the baffle plate construction 132 is displaced farther into the combustion chamber, so that the primary flame zone extends farther into the combustion chamber and the primary flame ensures a secure support of the secondary flame.

In particular in a full-load range, fuel is premixed by the third fuel nozzles 74 in the premixing zone 78 with the combustion air located therein by way of the third mixing unit 22, to produce a third fuel-air mixture, which is swirled by the swirl generator 76 and delivered in the swirled state into a swirled flame zone 124, to produce a premixed swirled flame here.

Sealing air is delivered by the sealing air producing unit into a sealing air zone 126, which encloses the primary flame zone 120 in a ring shape and is arranged between the primary flame zone 120 and the swirled flame zone 124.

As is apparent from FIG. 3, multiple different zones thus form in operation as follows in the region at the end of the burner head 14 facing toward the combustion chamber:

In a central region, a baffle-plate-supported primary flame is formed in a central primary flame zone 120; this is protected and supported by ring-shaped sealing air in the sealing air zone 126, which is enclosed by the swirled flame zone 124, in which a premixed swirled flame forms. A secondary flame zone 122 is formed on the outside around the swirled flame zone 124, in which a secondary flame is formed.

Due to the premixed swirled flame, a more favourable mixing ratio of fuel to air may be achieved at higher burner loads; wherein the secondary flame zone 122 simultaneously ensures exhaust gas circulation in the interior of the combustion chamber.

As an additional measure, an internal exhaust gas circulation can be provided. For this purpose, exhaust gas from the combustion chamber can be admixed to the air supply of the burner, so that an exhaust gas component is already located in the air flow produced by the fan in the burner tube.

A greater flame stability may be achieved by the measures of the flame support, in particular the sealing air and the premixed swirled flame, so that a higher proportion of exhaust gas can be admixed and the flame temperature can thus be lowered.

Figure 6:
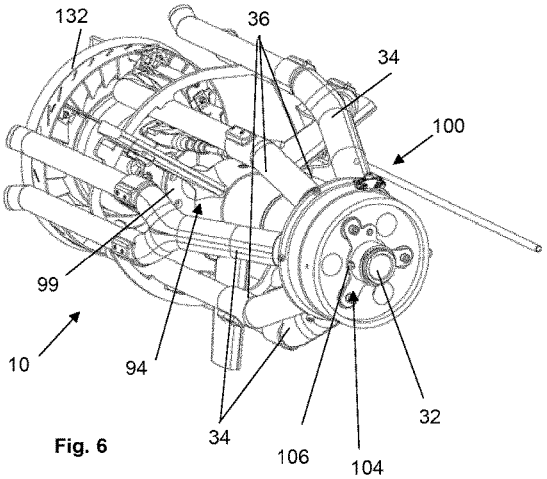
FIG. 6 shows a perspective illustration of the mixing device in the part load setting of FIG. 4.
Figure 7:
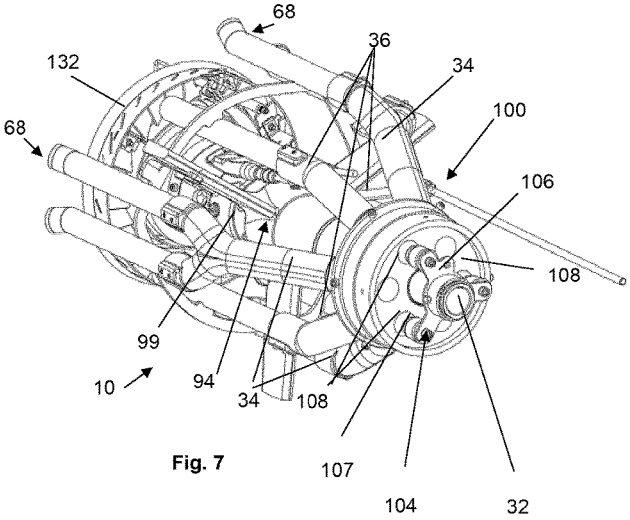
FIG. 7 shows the perspective illustration comparable to FIG. 6 in a full-load setting as in FIG. 5.

FIGS. 4 and 6 show a setting of the burner head 14 and the mixing device 10 for a part-load mode, while FIGS. 5 and 7 show a setting for a full-load mode.

For a part-load mode, the positioning unit 100 is actuated via the fuel supply controller in such a way that the displaceable central unit 99 having the support body 42, the baffle plate ring body 64, and the swirl generator 76 moves downstream. In the end position shown, the outer ring gap 119 between the guiding unit 88 and the end flange 116 is thus reduced in size, and the fuel supply only takes place via the first mixing unit and the second mixing unit 18, 20.

Furthermore, the ring body 52 and the baffle plate 40 are moved farther into the combustion chamber.

In the full-load position shown in FIGS. 5 and 7, in contrast, the fuel supply to the third mixing unit 22 is also opened and the ring gap 119 for the second mixing unit 20 is enlarged. Moreover, the ring body 52 and the baffle plate 40 are arranged more inside the burner tube 12.

In the fuel supply feed 28, a line for primary gas branches off from a mixing housing 128 of the gas supply line 30 as the first fuel supply line 32, a line for secondary gas branches off as the second fuel supply line 34, and a line for swirled gas branches off as the third fuel supply line 36, wherein the quantity of the swirled gas is controllable via a swirled gas controller. This may be controlled via a drive linkage.

In full load, for example, fuel quantities of swirled gas to secondary gas between 40:60 and 60:40 can be provided; for example, a quantity ratio of approximately 50:50 is provided.

A significant advantage of the mixing device shown here and the combustion method which can be carried out thereby with combustion of different zones is an increase of the stability. Larger quantities of exhaust gas can thus be recirculated. A lower flame temperature may thus be achieved even at high powers.

In the primary flame, preferably at most 10% of the burner power is produced and/or at most 10% of the fuel is combusted; 90% is supplied as secondary gas or as secondary gas and swirled gas.

At full load, the baffle plate construction is moved into the burner head 14 to enable a greater air passage. A change of the fuel quantity ratio between swirled gas and secondary gas can thus also be performed simultaneously; in a part-load mode, the supply of swirled gas to the swirled air is preferably entirely suppressed. The fuel supplies to the different mixing devices 18, 20, 22 or regions thereof can thus be used as power steps of the burner 16, which can be switched on or switched off depending on the load requirement.

In full load, for example, 40-70%, preferably 50%, of the fuel can be combusted in the secondary flame, 30 to 60%, preferably 45% in the premixed swirled gas flame, and 1 to 10%, preferably 5% in the primary flame. The corresponding fuel distribution may be achieved by relative dimensioning of flow cross sections of the fuel supply lines 32, 34, 36 and by the build-up of different partial vacuum zones at the different fuel nozzles 38, 70, 74 by corresponding flow guiding measures and/or dimensioning of the flow resistance of the different regions of the baffle plate construction.

Although gas burners for combusting gaseous fuels, such as natural gas in particular, have been described here as preferred exemplary embodiments, the construction shown here is thus also applicable to other types of burners, in particular to combination burners for combusting gaseous and liquid fuels.

For more specific details on the possible construction of the burner, reference is expressly made to the above-mentioned citations (EP 0 913 631 A2; "Weishaupt WKGL70 dual fuel burner Version 3LN (Low Nor) multiflam®", Weishaupt Corporation, Mississauga, printing number 83204616, March 2004; "Weishaupt Monarch® WM-GL10 Multiflam®", printing number 83192001, March 2009; and "Weishaupt Produkt Information über Öl-, Gas- und Zweistoffbrenner [product information about oil, gas, and dual fuel burners]", printing number 83211401, November 2015), which represent part of the present disclosure. In addition, in one particular embodiment, an exhaust gas recirculation line is provided, which is to be connected to the combustion chamber, on the one hand, and to an air intake for the combustion air, on the other hand, to admix exhaust gas from the combustion chamber to the combustion air flow.

LIST OF REFERENCE SIGNS

10 mixing device
12 burner tube
14 burner head
16 burner
18 first mixing unit
20 second mixing unit
22 third mixing unit
24 sealing air producing unit
26 fuel supply unit
28 fuel supply feed
30 gas supply line
32 first fuel supply line
34 second fuel supply line
36 third fuel supply line
37 ignition device
38 first fuel nozzle
39 fuel nozzle unit
40 baffle plate
42 support body
44 ring flange
45 plate region
46 blade
48 central opening
50 opening in blade
52 ring body
54 inner wall
56 outer wall
58 ring duct
60 tapering region
62 orifice region
64 baffle plate ring body
66 strut
68 fuel nozzle unit
70 second fuel nozzle
72 fork
74 third fuel nozzles
76 swirl generator
78 premixing zone
80 swirl blade
82 swirl blade arrangement
84 inner support ring
86 outer support ring
88 guiding unit
90 axially extending ring region
92 ring region oriented diagonally outward
94 support construction
96 support body
98 line branch
99 displaceable central unit
100 positioning unit
102 fastening strut
104 control valve
106 positioning element

107 closure body
108 entry opening
110 pushrod
112 first tapering point
114 second tapering point
116 end flange
118 combustion chamber opening
119 ring gap
120 primary flame zone
122 secondary flame zone
124 swirled flame zone
126 sealing air zone
128 mixing housing
130 swirled gas controller
132 baffle plate construction

The invention claimed is:

1. A mixing device (10) for a burner (16) having reduced NOx production, comprising:

a first mixing unit (18) arranged centrally for producing a first fuel-air mixture for a primary flame zone (120), wherein the first mixing unit (18) has at least one first fuel nozzle (38) and a baffle plate (40);

a second mixing unit (20) for producing a second fuel-air mixture for a secondary flame zone (122), which encloses the primary flame zone (120), wherein the second mixing unit (20) has multiple second fuel nozzles (70), and wherein the second mixing unit (20) is designed to deliver the second fuel-air mixture into the secondary flame zone (122);

a third mixing unit (22) for premixing and swirling a third fuel-air mixture and for delivering the premixed and swirled third fuel-air mixture into a swirled flame zone (124), which is arranged between the primary flame zone (120) and the secondary flame zone (122); and a sealing air producing unit (24) arranged downstream of the baffle plate (40) for producing a sealing air flow in a sealing air zone (126), which encloses the primary flame zone (120) of the first mixing unit (18) and is enclosed by the swirled flame zone (124) of the third mixing unit (22).

2. The mixing device according to claim 1, characterized in that the third mixing unit is arranged, in particular radially, between the sealing air producing unit (24) and the second mixing unit (20) and has a swirl generator (76) and at least one third fuel nozzle (74), which is arranged upstream of the swirl generator (76) in a premixing zone (78), through which an air flow flows to the swirl generator (76), to premix fuel from the third fuel nozzle (74) with the air flow before the swirl generation.

3. The mixing device according to claim 2, characterized in that a baffle plate construction (132) is provided which has, viewed from a centre of the mixing device (10) outward, in this sequence:

the baffle plate (40) having at least one opening (50) for the first fuel nozzle (38);

a sealing air duct for producing the sealing air flow, provided with at least one first partition wall (54) for partitioning the sealing air flow in relation to the primary flame zone and/or a second partition wall (56) for partitioning the sealing air flow in relation to the outlet of the swirl generator;

the swirl generator (76); and a guiding unit (88) for delimiting an outer air gap (119) for the second mixing unit (20).

4. The mixing device according to claim 1, characterized in that the baffle plate (40) is designed to produce a swirl in the primary flame zone (120).

5. The mixing device (10) according to claim 1, characterized in that a positioning unit (100) is provided for increasing or reducing in size an air gap (119), wherein the positioning unit (100) is designed to change the size of the air gap (119) in dependence on a load operating state.

6. The mixing device according to claim 5, characterized in that the positioning unit is designed to change the size of the air gap by changing the axial location of at least a part of the first mixing unit (18) and/or the sealing air producing unit (24) and/or the swirl generator (76) and/or an air guiding unit (88).

7. The mixing device (10) according to claim 1, characterized by a fuel supply unit (26) for supplying the first, second, and third mixing units (18, 20, 22) with fuel, wherein the fuel supply unit (26) is designed in such a way that the ratio of the fuel quantities flowing to the second and third mixing units (20, 22) is changeable.

8. The mixing device (10) according to claim 7, characterized by at least one, multiple, or all of the following features:

a fuel supply controller is provided for controlling the fuel supply unit (26), wherein the fuel supply controller is designed in such a way that a fuel supply (28) to the third mixing unit (22) is throttled or closed in a part-load mode and is open in a full-load mode;

the fuel supply unit (26) has a control valve (104) for changing a flow cross section of a fuel supply line (36) of the at least one third fuel nozzle (74); and/or a positioning element (106) of the control valve (104) is coupled to the positioning unit (100) for joint movement.

9. The mixing device (10) according to claim 1, characterized in that the sealing air producing unit (24) has a ring body (52) having a ring duct (58) for the sealing air.

10. The mixing device (10) according to claim 9, characterized by at least one, multiple, or all of the following features:

the ring duct (58) is formed on a baffle plate ring body (64), which forms the baffle plate (40) and the ring body (52);

the swirl generator (76) has a ring-shaped arrangement (82) of swirl generating blades (80) arranged around the ring duct (58); and/or the arrangement (82) of swirl generating blades (80) is formed on the ring body (52).

11. A burner head (14) for a burner (16) having reduced NOx production, comprising a burner tube (12) and the mixing device (10) of claim 1 arranged in the burner tube (12).

12. The burner head (14) according to claim 11, having the mixing device of claim 3, wherein the outer air gap (119) for delivering the second fuel-air mixture of the second mixing unit (20) is delimited on the outside by a region of the burner tube (12).

13. A burner (16) having the mixing device (10) of claim 1.

14. A method for combusting a fuel having reduced NOx production, comprising:

providing a first fuel-air mixture for producing a central primary flame in a central primary flame zone (120) by means of a first fuel nozzle (38) and a baffle plate (40) associated with the first fuel nozzle (38);

providing a second fuel-air mixture for producing a secondary flame in an outer secondary flame zone (122), which encloses the primary flame zone (120), by means of a second fuel nozzle (70);

producing a sealing air flow, which encloses the primary flame zone (120), between the primary flame zone (120) and the secondary flame zone (122); and providing a third fuel-air mixture by premixing fuel and air in a premixing zone (78), swirling the premixed fuel-air mixture, and delivering the swirled premixed fuel-air mixture into a swirled air zone, which is arranged between the sealing air flow enclosing the primary flame zone (120) and the secondary flame zone (122), wherein the swirled premixed fuel-air mixture is provided by a swirl generator (76) and at least one third fuel nozzle (74) disposed upstream of the swirl generator (76).

15. The method according to claim 14, carried out using the mixing device (10) claim 1.

16. The method according to claim 14, carried out using the burner head (14) of claim 11.

17. The method according to claim 14, carried out using the burner (16) of claim 13.

18. The burner head (14) according to claim 11, having the mixing device of claim 5, wherein the outer air gap (119) for delivering the second fuel-air mixture of the second mixing unit (20) is delimited on the outside by a region of the burner tube (12).

19. A burner (16) having the burner head (14) of claim 11.

20. The burner of claim 19, further having the mixing device (10) of claim 1.

* * * * *